United States Patent [19]

Kral

[11] 4,311,329

[45] Jan. 19, 1982

[54] PANIC-TYPE DEVICE HAVING FUSIBLE SECTION IN PUSH ROD TO AVOID UNINTENTIONAL OPENING OF DOOR IN EVENT OF FIRE

[75] Inventor: Stephen L. Kral, Garfield Heights, Ohio

[73] Assignee: Scovill Inc., Waterbury, Conn.

[21] Appl. No.: 90,557

[22] Filed: Nov. 2, 1979

[51] Int. Cl.[3] ..... E05C 15/02

[52] U.S. Cl. ..... 292/92; 292/DIG. 66; 49/1; 49/7

[58] Field of Search ..... 292/21, 92, DIG. 66; 49/1, 7

[56] References Cited

U.S. PATENT DOCUMENTS

| | | | |
|---|---|---|---|
| 2,772,905 | 12/1956 | Dusing | 292/DIG. 66 |
| 3,705,739 | 12/1972 | Adler | 49/1 X |
| 4,099,753 | 7/1978 | Gwozdz et al. | 292/DIG. 66 X |
| 4,200,954 | 5/1980 | McCabe | 292/DIG. 66 |

*Primary Examiner*—Richard E. Moore

*Attorney, Agent, or Firm*—Dallett Hoopes

[57] ABSTRACT

Push rod of panic-type latching device contains a fusible section which melts in the event of a hot fire so that the temperature will not cause elongation of push rod to disengage upper door latch.

2 Claims, 4 Drawing Figures

PANIC-TYPE DEVICE HAVING FUSIBLE SECTION IN PUSH ROD TO AVOID UNINTENTIONAL OPENING OF DOOR IN EVENT OF FIRE

BACKGROUND OF THE INVENTION

1. Field of the Invention:

This invention relates to a panic-type exit device of the type having a waist-level housing with a vertical rod extending to an upper latch at the top of the door. More specifically, the invention contemplates a provision in such a push rod of a fusible section which will melt and preclude the unintentional opening of the door as the push rod expands in a fire.

2. Description of the Prior Art:

In the prior art, of course, it is common to provide exit doors in public buildings with panic-type operators. Some of these operators include latches at the top of the door which are operated by a push rod extending up from a housing adjacent the door operator. The upper latch is arranged so that a vertically upward movement of the push rod will disengage the latch from its strike in the upper member of the door frame.

A problem is presented by the arrangement described in that in the event of a hot fire where it is desired to have the doors completely closed to avoid spreading to adjacent structures, the heat of the fire can effect an elongation of the push rod to cause an inadvertent unlatching of the door. The pressure built up inside the fire area, or the pressure of the water from a fire hose, can thereafter in effect "blow" the door open to break down the isolation of the fire area and threaten further spread.

In the prior art, there are teachings of the idea of fusible portions of latch structure to avoid the unlatching of the door on occasion of fire. An example is disclosed in the Dusing U.S. Pat. No. 2,772,905, issued Dec. 4, 1956. In this patent, structure surrounding the latch operator, being of a special low temperature alloy, melts away in the event of a fire to preclude the warpage of a door causing the door to become unlatched.

SUMMARY OF THE PRESENT INVENTION

Under the present invention, an extremely simple arrangement is provided for avoiding the inadvertent opening of doors of the conventional panic-type. It includes the provision in the upper latch push rod of a fusible section adapted to melt upon encountering intense heat of the fire, rendering the push rod non-operative. The fusible section, preferably adjacent the waist-level housing of the exit device, is readily replaceable if it is desired or necessary.

BRIEF DESCRIPTION OF THE DRAWINGS

Other features and objects of the invention will be apparent from a reading of the following specification and a study of the drawings, all of which disclose a non-limiting embodiment of the invention. In the drawings.

DESCRIPTION OF THE PREFERRED EMBODIMENT

Figure 1:
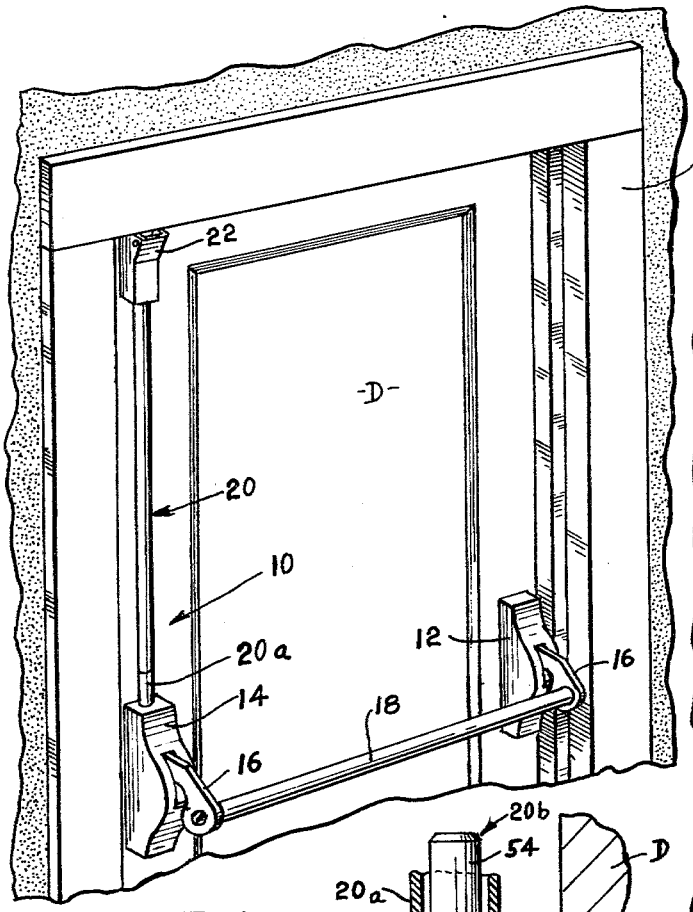
FIG. 1 is a fragmentary perspective view of a door having a panic device embodying the invention.

Referring more specifically to the drawings, a closure device embodying the invention is generally designated 10 and shown installed on a door D hinged to a frame F in FIG. 1. It comprises pivots housed in covers 12 and 14 and includes levers 16 which mount a panic bar 18. Extending upwardly from the leftward housing 14 is a push rod 20 which extends into a latch cover 22 in which is housed a conventional latch mechanism (not shown). In operation, the panic bar 16 is pushed towards the door which raises the vertical push rod 20 to activate the latching within the upper housing 22 to unlatch the upper part of the door.

Figure 3:
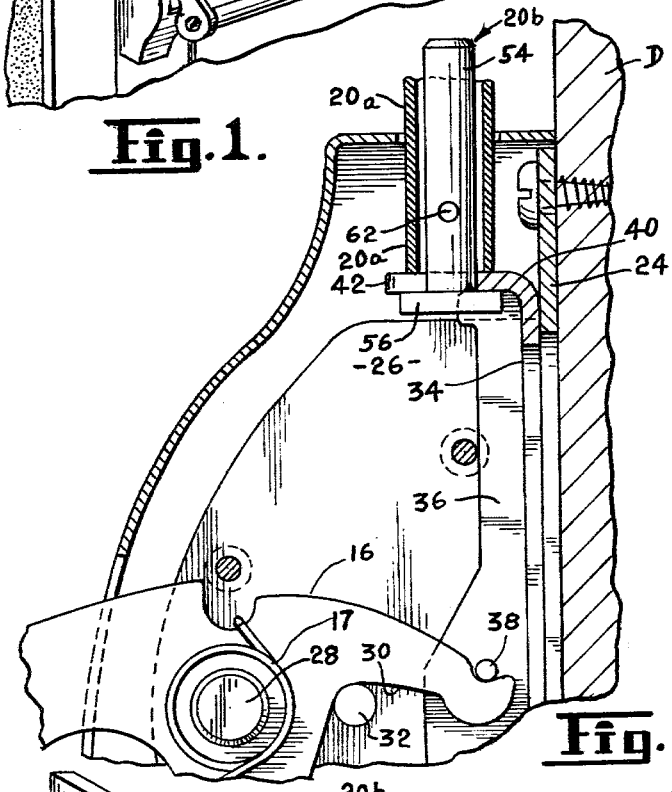
FIG. 3 is a sectional view taken on the line 3—3 of FIG. 2.
Figure 4:
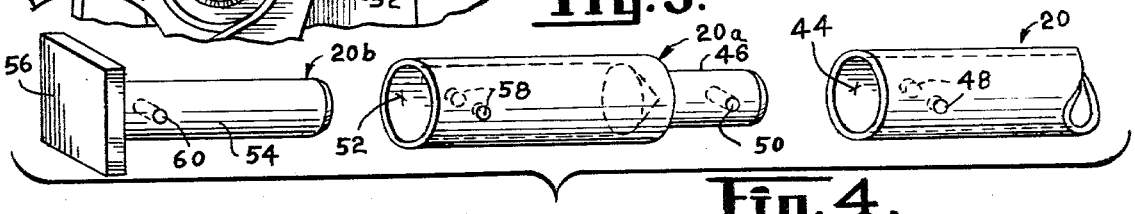
FIG. 4 is an exploded view of the fusible section area of a panic device embodying the invention.

Referring to FIG. 3, the operator includes the base plate 24 which is screwed onto the door D. The plate is formed with spaced outward plates 26 between which extend a rigid pivot pin 28 to which is pivotally attached the lever 16. The lever 16 is biased upwardly as by spring 17 and includes a downwardly facing shoulder 30 which normally abuts the stop 32. Vertically reciprocally held between the plates 26 is the carriage 34. The carriage has sidewalls 36 between which is disposed a rigid pin 38. The upper end of the carriage is formed with a horizontally disposed yoke 40 comprising a pair of horizontally spaced fingers 42.

The push rod 20 is joined at its lower end to a fusible portion **20*a* and a headed element 20*b***, all part of the rod assembly.

The lower end of the rod 20 is formed with an axial opening 44 which snugly receives a reduced stud 46 on the upper end of the fusible section **20*a*. These two elements may be pinned together as by a pin 47 extending through openings 48 and 50 in the rod and reduced stud respectively. The opposite end of the fusible section is likewise formed with an axial opening 52 and it receives the reduced shank 54 of the headed element 20*b*. As shown, the headed element presents a square head 56**.

Figure 2:
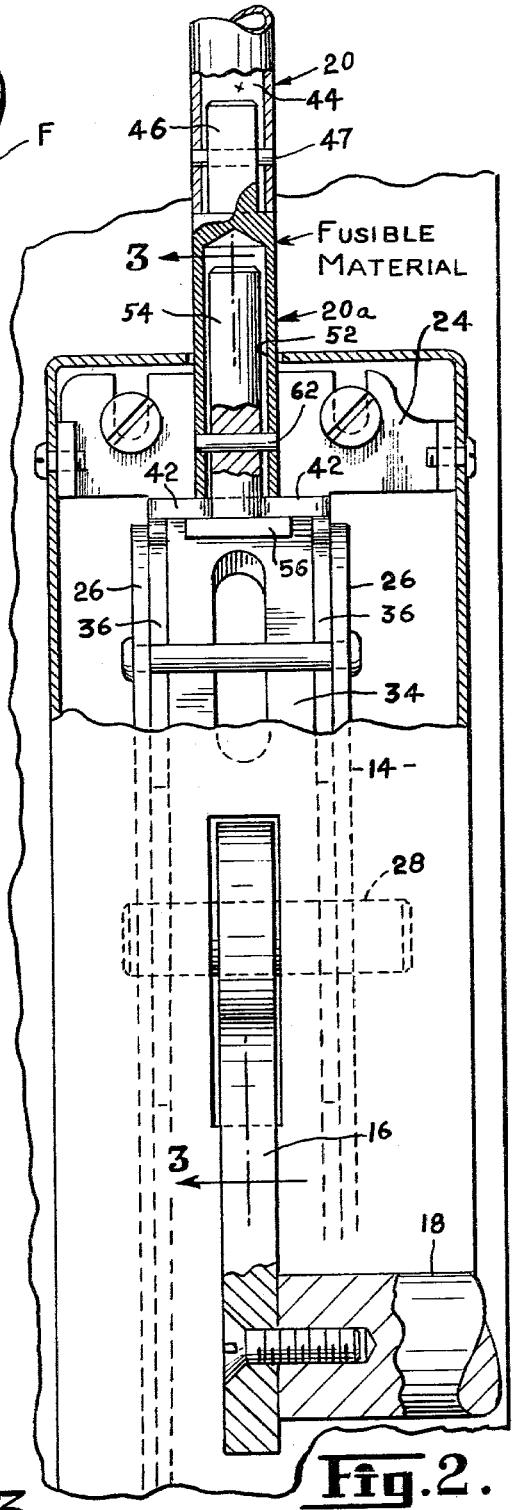
FIG. 2 is a greatly enlarged front view showing the operator housing with its cover partly broken away.

In actual installation, the headed element is held within the fusible element **20*a* by bores 58 and 60 extending through the section and headed element respectively, which receive a single anchoring pin as at 62 (FIG. 2**).

As shown best in FIG. 2, the two fingers 42 slide between the bottom end of the fusible section **20*a* and the upper surface of the head 56. Disposed inside between the fingers 42 is a lower portion of the shank 54** of the headed member.

With the structure as described, a push-on panic bar 18 toward the door causes the inner end of the lever 16 to raise up the pin 38 (FIG. 3) thereby raising the carriage 34, the yoke 40, and the push rod assembly.

Now, attention is called to the purpose to which the invention relates. In a fire, upon attainment of the preselected melting point of the section **20*a*, that section fuses and disappears leaving only a melted residue. Because the lower end of rod 20 is thereafter unanchored, the upward raising of the rod 20** as it expands is prevented.

Preferably, the metal of the section **20*a*** may be of aluminum, manufactured from aluminum rod, which will melt in the neighborhood of 650° or 700° Centigrade.

If, after the fire, the door is still intact and it is desired to rebuild the device, it is only necessary to re-install a fusible section **20*a* at the bottom of the push rod 20 and to reinstall a headed element 20*b*** into the fusible element 20*a*. This is done by the use of pins such as 47, 62, as described.

While the invention has been shown in but one embodiment, it is capable of many changes and modifications, all of which fall within the scope of the following claim language claiming the invention.

I claim:

1. A latching device operable by a panic member and including a waist-level housing pivotally mounting a lever terminating outwardly in said panic member; a yoke element engaged by the lever and adapted to raise when the panic member is pushed toward the door, the yoke element comprising a pair of spaced horizontal fingers; a latch at the upper end of the door and a push rod extending between the housing and the latch adapted on the actuation of the lever to move upward to actuate the upper latch, the lower portion of the push rod terminating in a fusible section, said section being formed with an upward axial opening in its lower end; and a headed element having a reduced shank extending up into the opening, the head being spaced from said end, the head and end being disposed respectively closely below and above the fingers and the shank being disposed between the fingers thereby linking the up and downward movement of the yoke and the push rod whereby under extreme heat the fusible section will melt to prevent the thermal expansion of the rod from inadvertently unlatching the upper latch.

2. A latching device as claimed in claim 1 wherein the shank is held in the opening in the fusible section by a transverse pin extending through aligned holes in the adjacent parts.

* * * * *